US008838004B2

(12) United States Patent
Shimao et al.

(10) Patent No.: US 8,838,004 B2
(45) Date of Patent: Sep. 16, 2014

(54) GLOSS PROCESSING APPARATUS

(71) Applicants: Teruo Shimao, Osaka (JP) Toshie Shimao, Osaka (JP)

(72) Inventors: Satoshi Shimao, Aichi (JP); Katsunori Takahashi, Tokyo (JP); Kenji Tamaki, Saitama (JP); Kenichi Hayashi, Tokyo (JP); Yumiko Izumiya, Tokyo (JP); Kazutoshi Yoshimura, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 67 days.

(21) Appl. No.: 13/761,615

(22) Filed: Feb. 7, 2013

(65) Prior Publication Data

US 2013/0206064 A1 Aug. 15, 2013

(30) Foreign Application Priority Data

Feb. 13, 2012 (JP) ..... 2012-28448

(51) Int. Cl.

| | |
|---|---|
| ***G03G 15/20*** | (2006.01) |
| ***G03G 15/00*** | (2006.01) |
| ***B05C 11/00*** | (2006.01) |
| ***G03G 8/00*** | (2006.01) |

(52) U.S. Cl.

CPC . *B05C 11/00* (2013.01); *G03G 8/00* (2013.01)
USPC ..... 399/341; 399/45; 399/407

(58) Field of Classification Search

USPC ..... 118/712; 399/45, 341, 342, 407; 430/124.13, 126.1
See application file for complete search history.

(56) References Cited

U.S. PATENT DOCUMENTS

| | | | | |
|---|---|---|---|---|
| 7,184,698 | B2 * | 2/2007 | Tombs | 399/341 |
| 7,203,434 | B2 * | 4/2007 | Nakayama | 399/45 X |
| 7,995,959 | B2 * | 8/2011 | Nakamura et al. | 399/341 |
| 8,565,633 | B2 * | 10/2013 | Sonohara et al. | 399/45 X |
| 2010/0329752 | A1 * | 12/2010 | Schulze-Hagenest et al. | 399/328 |

FOREIGN PATENT DOCUMENTS

| | | |
|---|---|---|
| JP | 2010-211055 | 9/2010 |

* cited by examiner

*Primary Examiner* — Sandra Brase
(74) *Attorney, Agent, or Firm* — Lucas & Mercanti, LLP

(57) ABSTRACT

A sheet of paper is set on a paper-supplying portion of a back surface gloss processing apparatus while its top surface is faced upward. A gloss level sensor measures a gloss level of a back surface of the sheet of paper. Data of this measurement is compared with a previously set threshold value. When this measurement result does not exceed the threshold value, it is determined that the gloss processing has not been performed on the back surface thereof. It is then determined whether or not the presently set operation mode is a top surface gloss processing mode. When determining that the present operation mode is not the top surface gloss processing mode, the operation mode is automatically changed from a presently set back surface gloss processing mode to the top surface gloss processing mode.

9 Claims, 5 Drawing Sheets

GLOSS PROCESSING APPARATUS

CROSS REFERENCE TO RELATED APPLICATION

This application is based on Japanese Patent Application No. 2012-28448 filed with Japanese Patent Office on Feb. 13, 2012, the entire contents of which being hereby incorporated by reference.

BACKGROUND OF THE INVENTION

1. Field of the Invention

The present invention relates to a gloss processing apparatus which applies any glossy effect to a sheet of paper by performing a gloss processing on the sheet of paper on which any clear toner has been provisionally fixed.

2. Description of Related Art

In the recent year, in order to allow an image to be vividly represented in a printing field such as photograph(s), a photo book and a product leaflet, any gloss processing to enhance a glossy effect has been performed. In the gloss processing, a clear toner has been generally applied to a top surface of the sheet of paper in which an image has been formed. The top surface of the sheet of paper then has any glossy effect by heating and pressing the clear toner to smooth the top surface, by putting a sheet-like thin film having any smoothness on a top layer of the image or by coating water-soluble varnish or ultraviolet curing materials on a top surface of the sheet of paper.

For example, Japanese Patent Application Publication No. 2010-211055 has disclosed an image forming apparatus that performs a series of a paper-supply processing, a printing processing and a glossing processing in one apparatus to control the glossy effect to be applied on the image based on property of the sheet of paper.

This image forming apparatus disclosed in Japanese Patent Application Publication No. 2010-211055 may have low productivity because it performs a series of processing from the image forming processing to the gloss processing in one apparatus. Since this image forming apparatus is not an apparatus for exclusive use of gloss processing, the image forming apparatus may be insufficient for compatibility of electro photographic output. It is thus difficult to obtain high glossy effect (for example, glossy effect that is greater than that by varnish coating).

On the other hand, apart from the image forming apparatus that performs such an image forming, a gloss processing apparatus that has an off-line configuration and is an apparatus for exclusive use of gloss processing has been developed. In such a gloss processing apparatus, the top surface side of a sheet of paper can have any glossy effect by, for example, re-melting clear toner layer, which has been provisionally fixed on an image forming side of a sheet of paper, smoothing the surface thereof by using smoothing member, solidifying the smoothed clear toner layer by using cooling fans, and peeling the sheet of paper from the smoothing member.

SUMMARY OF THE INVENTION

Such a gloss processing apparatus, however, has an off-line configuration so that an operator moves a sheet of paper on which any clear toner has been provisionally fixed by a provisionally fixative apparatus to the gloss processing apparatus to set the sheet of paper in a paper-supplying tray therein by hand. In this moment, the operator may make a mistake in setting a sheet of paper, on which any gloss processing is not to be performed, on the paper-supplying tray of the gloss processing apparatus. For example, the operator may make a mistake in setting the sheet of paper, on which the gloss processing for a top surface thereof will be performed, on the paper-supplying tray of the gloss processing apparatus for a back surface of the sheet of paper, which performs any gloss processing on the back surface of the sheet of paper. In this case, the gloss processing apparatus for the back surface of the sheet of paper is normally set so that the gloss processing conditions thereof such as fixing temperature, a transfer velocity of the sheet of paper, nipping pressure and the like are different to those of the gloss processing apparatus for the top surface of the sheet of paper. Accordingly, it may be impossible to perform a suitable fixing processing for a target gloss processing, namely, gloss processing for the top surface of the sheet of paper. This causes a jam to occur in the gloss processing apparatus for the back surface of the sheet of paper and/or causes poor quality to occur in the image on the top surface of the sheet of paper.

This invention addresses the above-mentioned issues and has an object to provide an improved gloss processing apparatus that is capable of preventing a jam from occurring in the gloss processing apparatus daring a period of gloss processing or preventing any poor quality from occurring in the image.

To achieve the above-mentioned object, a gloss processing apparatus reflecting one aspect of the present invention contains a gloss processing portion that performs gloss processing on a sheet of paper on which clear toner has been provisionally fixed, a gloss-level-measuring portion for a back surface of the sheet of paper which is an opposite surface of a top surface of the sheet of paper, on which the gloss processing portion performs the gloss processing, the gloss-level-measuring portion measuring a gloss level of the back surface of the sheet of paper, the gloss-level-measuring portion being positioned at an upstream side of the gloss processing portion along a sheet-transferring direction, and a control portion that is configured to select separate gloss processing modes according to a case where the gloss processing is performed on the back surface of the sheet of paper or a case where the gloss processing is not performed on the back surface of the sheet of paper, based on a measurement result of the gloss-level-measuring portion for the back surface of the sheet of paper, wherein the control portion changes its processing mode to the gloss processing mode selected on the base of the measurement result of the gloss-level-measuring portion for the back surface of the sheet of paper when the control portion determines that the gloss processing mode selected on the base of the measurement result of the gloss-level-measuring portion for the back surface of the sheet of paper is different from a previously set gloss processing mode.

It is desirable to provide the gloss processing apparatus wherein the control portion determines whether or not the gloss processing is performed on the back surface of the sheet of paper by comparing the gloss level measured by the gloss-level-measuring portion for the back surface of the sheet of paper with a threshold value that is a criterion of the gloss level.

It is also desirable to provide the gloss processing apparatus wherein the gloss-level-measuring portion for the back surface of the sheet of paper contains plural sensors or a line sensor in which sensors are arranged on a line.

It is further desirable to provide the gloss processing apparatus further containing a gloss-level-measuring portion for a top surface of the sheet of paper, the gloss-level-measuring portion measuring a gloss level of the top surface of the sheet of paper which has been passed through the gloss processing portion, the gloss-level-measuring portion for the top surface of the sheet of paper being positioned at a downstream side of the gloss processing portion along the sheet-transferring direction, wherein the control portion determines whether or not the gloss processing portion has properly performed the gloss processing on the top surface of the sheet of paper based on a measurement result of the gloss level of the top surface of the sheet of paper by the gloss-level-measuring portion for the top surface of the sheet of paper.

It is additionally desirable to provide the gloss processing apparatus wherein the control portion determines whether or not the gloss processing portion has properly performed the gloss processing on the top surface of the sheet of paper by comparing the gloss level measured by the gloss-level-measuring portion for the top surface of the sheet of paper with a threshold value that is a criterion of the gloss level.

It is still further desirable to provide the gloss processing apparatus further containing a notifying portion which notifies that the gloss processing portion has not properly performed the gloss processing on the top surface of the sheet of paper when the control portion determines that the gloss processing portion has not properly performed the gloss processing on the top surface of the sheet of paper.

It is still additionally desirable to provide the gloss processing apparatus wherein the gloss-level-measuring portion for the top surface of the sheet of paper contains plural sensors or a line sensor in which sensors are arranged on a line.

It is also desirable to provide the gloss processing apparatus wherein the control portion is configured to select the gloss processing mode for the back surface of the sheet of paper when the gloss processing is performed on the back surface of the sheet of paper or to select the gloss processing mode for the top surface of the sheet of paper when the gloss processing is not performed on the back surface of the sheet of paper, and wherein the gloss processing modes for the top and back surfaces of the sheet of paper are different from each other in a gloss processing condition, during a period of gloss processing, including at least any one of fixing temperature and a transfer velocity of the sheet of paper.

It is additionally desirable to provide the gloss processing apparatus further containing a paper-supplying portion that stores the sheet of paper on which the clear toner has been provisionally fixed and supplies the sheet of paper to the gloss processing portion, the paper-supplying portion being positioned at the upstream side of the gloss processing portion along the sheet-transferring direction, wherein the first gloss-level-measuring portion is arranged in the paper-supplying portion.

It is to be noted that in this invention, the term, "gloss" means luster, shininess and/or brightness on a surface of the sheet of paper. For example, the gloss level is fixed by an extent of light by regular reflection of the light irradiated on the surface of the sheet of paper.

The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing(s) wherein like reference characters refer to like elements.

DETAILED DESCRIPTION OF THE PREFERRED EMBODIMENTS

Hereinbelow, typical embodiments of this invention will be explained with reference to the drawings. It should be noted that the present invention is not limited to the embodiments described below. Definitions of terms described below are given by way of explanation of the terms only, and thus the definitions of the terms of the invention are not limited thereto.

The following will describe the preferred embodiments to carry out the invention.

[Workflow Example of Gloss Processing]

Figure 1:
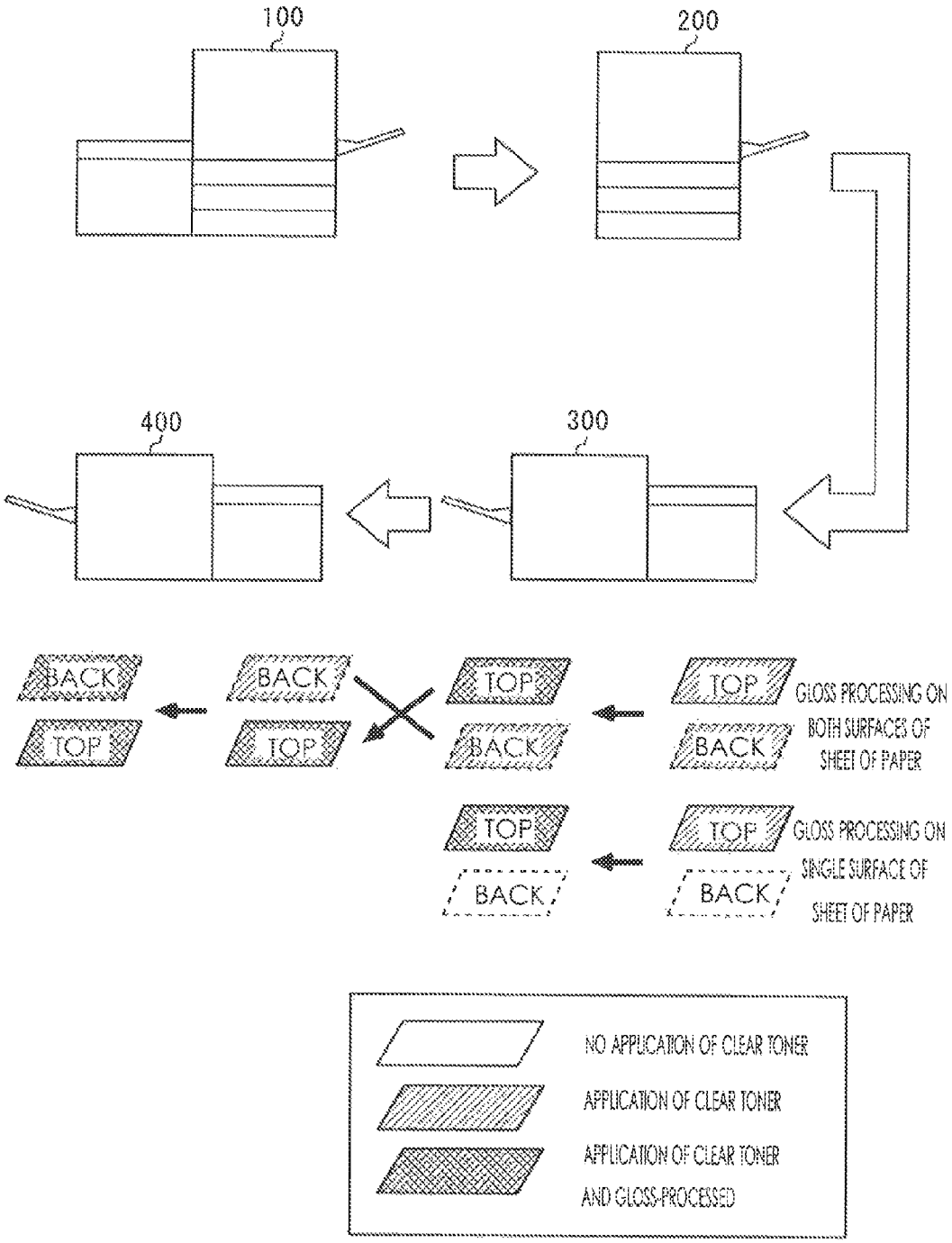
FIG. 1 is an outline diagram showing a workflow from an image forming step to a gloss processing step according to an embodiment of this invention.

First, a workflow from an image forming step in which images are formed on both surfaces of a sheet of paper P to a gloss processing step in which gloss processing is performed on both surfaces of the sheet of paper P will be described. FIG. 1 shows a workflow from the image forming step in which images are respectively formed on both surfaces of the sheet of paper P to the gloss processing step in which gloss processing is performed on each surface of the sheet of paper P, according to an embodiment of this invention. It is to be noted that following dimensions and/or ratios in the drawings may be emphasized for convenience of explanation and they may be different from their real values.

As shown in FIG. 1, to perform a series of the workflow from the image forming step to the gloss processing step, an image forming apparatus 100, a provisionally fixative apparatus 200, a gloss processing apparatus 300 for a top surface of the sheet of paper (hereinafter, referred to as "the top surface gloss processing apparatus 300"), and a gloss processing apparatus 400 for a back surface of the sheet of paper (hereinafter, referred to as "the back surface gloss processing apparatus 400") are used. In this embodiment, each apparatus is configured as off-line, namely, they are stand-alone apparatuses.

The image forming apparatus 100 forms a desired image on each surface of the sheet of paper P. As the image forming apparatus 100, any generally-used known image forming apparatus is used. Therefore, a detailed description of the image forming apparatus 100 will be omitted. When forming the desired image on each surface of the sheet of paper P, an operator moves the sheet of paper P, on both surfaces of which the images are formed, to the provisionally fixative apparatus 200 by hand and he or she sets the sheet of paper P on a paper-supplying portion of the provisionally fixative apparatus 200.

The provisionally fixative apparatus 200 applies any clear toner to each surface of the sheet of paper P, on both surfaces of which the images have been formed, to perform a provisional fixation processing. The provisional fixation processing is the processing in which the clear toner applied to the sheet of paper P is dissolved by heat so that it can be fixed on the sheet of paper P. The provisional fixation processing is the preprocessing stage of the gloss processing. This provisional fixation processing causes each surface of the sheet of paper P to have a mat appearance with low gloss. Since, as the provisionally fixative apparatus 200, any generally-used known one is used, a detailed description thereof will be omitted, similar to a case of the image forming apparatus 100. When finishing the provisional fixation processing, the operator moves the sheet of paper P, on each surface of which the provisional fixation processing is formed, from the provisionally fixative apparatus 200 to the top surface gloss processing apparatus 300 by hand and he or she sets the sheet of paper P on a paper-supplying portion of the top surface gloss processing apparatus 300.

The top surface gloss processing apparatus 300 performs a top surface gloss processing mode for a top surface of the sheet of paper P. The top surface gloss processing mode is referred as a gloss processing mode performed when performing the gloss processing on the sheet of paper P, on a top surface (or one surface) of which any clear toner has been provisionally fixed. In this top surface gloss processing mode, fixing temperature, a transfer velocity of the sheet of paper and the like during a period of gloss processing time are set so that they are suitable for a case of performing the gloss processing on the top surface of the sheet of paper P. For example, the fixing temperature is set to be 170° C. The transfer velocity of the sheet of paper is set to be 40 mm/sec.

In this top surface gloss processing mode, when the sheet of paper P is transferred, the clear toner layer provisionally fixed on the top surface of the sheet of paper P is again dissolved by the heating nip portion and a cooling member (cooling fans 440, which will be described later) then cools the clear toner layer, which is again dissolved, of the transferred sheet of paper while the clear toner layer is closely contacted with a smoothing member (a gloss-allowing belt 438, which will be described later). This allows the clear toner layer to be solidified conforming to a shape of the smoothing member. After the clear toner layer has been solidified, the sheet of paper P is peeled from the smoothing member and the top surface of the sheet of paper P is granted any glossy effect.

When finishing granting the top surface of the sheet of paper P any glossy effect, the operator moves the sheet of paper P, on the top surface of which the gloss processing has been formed but on the back surface of which the gloss processing has not been formed, to the back surface gloss processing apparatus 400 by hand. He or she then sets the sheet of paper P on a paper-supplying portion of the back surface gloss processing apparatus 400. In this case, he or she may set the sheet of paper P on the paper-supplying portion of the back surface gloss processing apparatus 400 with the back surface of the sheet of paper P, on which the gloss processing has not been yet performed, being faced upward. The back surface gloss processing apparatus 400 performs a back surface gloss processing mode for a back surface of the sheet of paper P. The back surface gloss processing mode is referred as a gloss processing mode performed when performing the gloss processing on the sheet of paper P, on a back surface of which the clear toner has been provisionally fixed (but the gloss processing has been already performed on its top surface). In this back surface gloss processing mode, fixing temperature, a transfer velocity of the sheet of paper and the like during a period of gloss processing time are set so that they are suitable for a case of performing the gloss processing on the back surface of the sheet of paper P. For example, the fixing temperature is set to be 150° C. The transfer velocity of the sheet of paper is set to be 70 mm/sec. The reason why the fixing temperature is set to be lower than that of the top surface gloss processing mode and the transfer velocity of the sheet of paper is set to be faster than that of the top surface gloss processing mode is because the gloss processing has been already performed on the top surface of the sheet of paper P and it is required to take into consideration any influence on glossy effect on this top surface, i.e., deterioration of image which is generated by dissolving the clear toner again. In the back surface gloss processing mode, similar to that of the top surface gloss processing mode, the clear toner layer provisionally fixed on the back surface of the sheet of paper P is again dissolved by the heating nip portion and the cooling member then cools the clear toner layer, which is again dissolved, of the transferred sheet of paper while the clear toner layer is closely contacted with the smoothing member. This allows the clear toner layer to be solidified conforming to a shape of the smoothing member. After the clear toner layer has been solidified, the sheet of paper P is peeled from the smoothing member and the back surface of the sheet of paper P is also granted any glossy effect. When allowing gloss on merely the single surface of the sheet of paper P, as shown in FIG. 1, only the top surface gloss processing apparatus 300 is used.

[Configuration Example of Back Surface Gloss Processing Apparatus]

Figure 2:
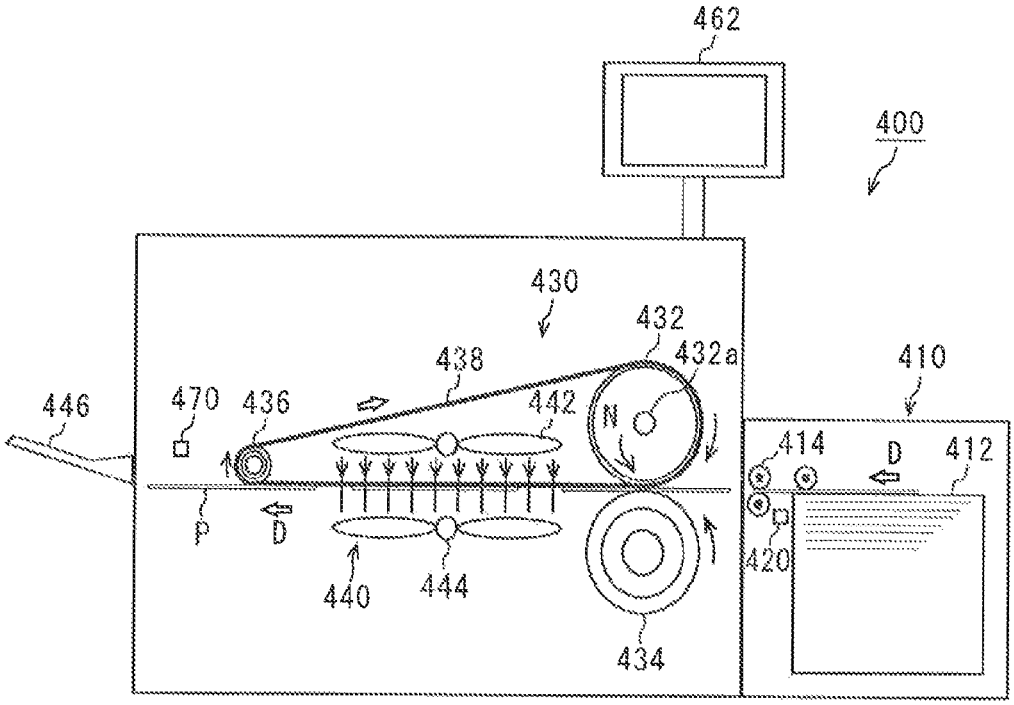
FIG. 2 is a diagram showing a configuration example of a gloss processing apparatus for a back surface of a sheet of paper.
Figure 3A:
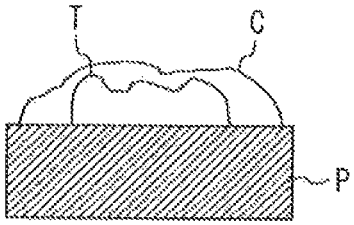
FIG. 3A is a diagram showing a step of the gloss processing in the gloss processing apparatus for the back surface of the sheet of paper.
Figure 3B:
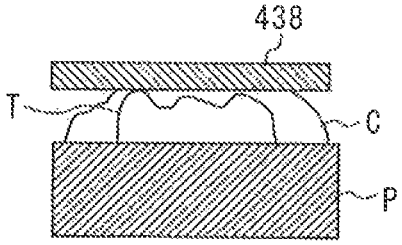
FIG. 3B is a diagram showing a step of the gloss processing in the gloss processing apparatus for the back surface of the sheet of paper.
Figure 3C:
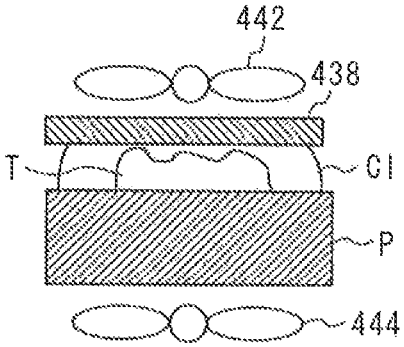
FIG. 3C is a diagram showing a step of the gloss processing in the gloss processing apparatus for the back surface of the sheet of paper.
Figure 3D:
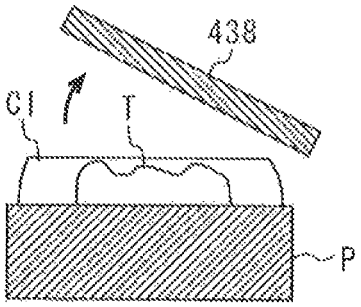
FIG. 3D is a diagram showing a step of the gloss processing in the gloss processing apparatus for the back surface of the sheet of paper.

The following will describe the back surface gloss processing apparatus 400. It is to be noted that since this embodiment principally relates to the back surface gloss processing apparatus 400, a detailed description of the top surface gloss processing apparatus 300 will be omitted. FIG. 2 shows a configuration example of the back surface gloss processing apparatus 400 according to this embodiment of the invention.

As shown in FIG. 2, the back surface gloss processing apparatus 400 includes a paper-supplying portion 410 and a gloss processing portion 430. The paper-supplying portion 410 is arranged at upstream side of the gloss processing portion 430 along a sheet-transferring direction D of the sheet of paper P. The paper-supplying portion 410 includes a paper-supplying tray 412, a transfer roll 414 and a gloss-level-measuring portion 420 for a back surface of the sheet of paper (hereinafter, referred to as "back surface gloss-level-measuring portion 420"). The paper-supplying tray 412 has a mounting table that is capable of being elevated. The sheet of paper P, on the top surface of which the gloss processing has been performed in the top surface gloss processing apparatus 300, is set on the mounting table. In this moment, the sheet of paper P is set on the paper-supplying tray 412 with the top surface thereof, on which the gloss processing has been already performed, being faced upward but the sheet of paper P may be set on the paper-supplying tray 412 with the back surface thereof being faced upward. The transfer roll 414 is arranged at a takeout side of the paper-supplying tray 412. The transfer roll 414 transfers the sheets of paper P taken out of the paper-supplying tray 412 one by one to the gloss processing portion 430 of downstream side.

The back surface gloss-level-measuring portion 420 is composed of, for example, a gloss level sensor including optical source and a light receiving element. The back surface gloss-level-measuring portion 420 is arranged near the takeout of the paper-supplying tray 412 and below a transfer path of the sheet of paper P. The back surface gloss-level-measuring portion 420 irradiates light to the back surface of the sheet of paper P which is being transferred to the gloss processing portion 430. The back surface gloss-level-measuring portion 420 then receives reflected light (for example, regular reflection) that is reflected by the back surface of the sheet of paper P. Thus, the back surface gloss-level-measuring portion 420 measures any gloss level of the back surface of the sheet of paper P. The back surface gloss-level-measuring portion 420 may be configured so as to be a single sensor or plural sensors. The back surface gloss-level-measuring portion 420 may be configured so as to be a line sensor in which gloss level sensors are arranged on a line. Such a gloss level sensor composed of plural sensors enables the gloss level of the back surface of the sheet of paper to be measured with high accuracy and preciseness.

The gloss processing portion 430 contains a manipulation display portion 462, a heating roll 432, a peel-off roll 436, the gloss-allowing belt 438, a pressure roll 434 and cooling fans 440. The manipulation display portion 462 is an example of a notifying portion. The manipulation display portion 462 is arranged at an upper surface of a housing of the back surface gloss processing apparatus 400. The manipulation display portion 462 receives any kinds of inputs by the operator, which are performed on a manipulation screen in a touch screen, such as setting of an operation mode (processing mode) and setting of a fixing condition including fixing temperature, a transfer velocity of the sheet of paper, nipping pressure and the like. The manipulation display portion 462 displays a warning message such that a trouble occurs in the apparatus when the trouble occurs in the apparatus or the like during a period of gloss processing time. It is to be noted that guidance by a voice or a buzzer to warn the operator may be used instead of such a warning message display.

The heating roll 432 is configured so as to have a cylindrical core barrel made of, for example, aluminum and a resin layer of polytetrafluoroethylene (PTFE) which coats an outer surface of the core barrel. The heating roll 432 includes a heater 432*a* for heating the gloss-allowing belt 438. As the heater 432*a*, plural heaters may be arranged along a paper-width direction in order to correspond to sheets of paper having different paper widths.

The peel-off roll 435 is arranged at a downstream side of the heating roll 432 along the sheet-transferring direction D of the sheet of paper P and at a position that is away from the heating roll 432 by a predetermined distance. Accompanying with a rotation of the heating roll 432 or the like, the peel-off roll 436 rotates. An interval between the heating roll 432 and the peel-off roll 436 is selected so that the interval is an optimal distance by which the sheet of paper P heated by the heating roll 432 can be cooled. The peel-off roll 436 has a curvature by which the sheet of paper P that is closely contacted with the gloss-allowing belt 438 can be peeled off the gloss-allowing belt 438. The peel-off roll 436 has a function to peel the sheet of paper P from the gloss-allowing belt 438 by its curvature.

The gloss-allowing belt 438 is configured so as to have a base body made of polyimide, an elastic layer made of heat-resistant silicon rubber, which coats an outer surface of the base body, and a coating layer made of perfluoroalkoxy (PFA) fluororesin, which coats a top layer of the elastic layer. The gloss-allowing belt 438 is configured so as to be an endless belt and is stretched between the heating roll 432 and the peel-off roll 436. This enables the gloss-allowing belt 438 to be transferred following a rotation of the heating roll 432 or the like. The gloss-allowing belt 438 transfers the sheet of paper P along the sheet-transferring direction D of the sheet of paper P with smoothing the clear toner layer.

The pressure roll 434 is arranged below the heating roll 432 so that it faces the heating roll 432. The pressure roll 434 is configured so as to have a cylindrical core barrel made of, for example, aluminum, an elastic layer made of heat-resistant silicon rubber, which coats an outer surface of the core barrel, and a resin layer made of PFA tube, which coats an outer circumference of the elastic layer. A nip portion N is formed between the pressure roll 434 and the heating roll 432 (or the gloss-allowing belt 438). The pressure roll 434 contacts the heating roll 432 with pressure via the gloss-allowing belt 438.

A gloss-level-measuring portion 470 for the top surface of the sheet of paper (hereinafter, referred to as "the top surface gloss-level-measuring portion 470) is composed of, for example, gloss level sensor including optical source and a light receiving element. The top surface gloss-level-measuring portion 470 is arranged at a downstream side of the peel-off roll 436 along the sheet-transferring direction D of the sheet of paper P and over the transfer path of the sheet of paper P. The top surface gloss-level-measuring portion 470 irradiates light onto the top surface of the sheet of paper P which is being transferred from the gloss processing portion 430. The top surface gloss-level-measuring portion 470 receives reflected light that is reflected by the top surface of the sheet of paper P. Thus, the top surface gloss-level-measuring portion 470 measures any gloss level of the top surface of the sheet of paper P. Namely, the top surface gloss-level-measuring portion 470 measures whether or not the gloss processing portion 430 has properly performed the gloss processing on the transferring sheet of paper P. The top surface gloss-level-measuring portion 470 may be configured so as to be a single gloss level sensor or plural gloss level sensors. The top surface gloss-level-measuring portion 470 may be configured so as to be a line sensor in which gloss level sensors are arranged on a line. Such a gloss level sensor composed of plural sensors enables the gloss level of the top surface of the sheet of paper to be measured with high accuracy and preciseness.

The cooling fans 440 are positioned on the transfer path between the heating roll 432 and the peel-off roll 430. In this embodiment, they are configured so as to be respectively arranged above and below the transfer path. The cooling fans 440 allow the sheet of paper P to be cooled from upward and downward directions, respectively. This enables the sheet of paper P that has been heated in the nip portion N to be cooled to a predetermined temperature so that the clear toner layer of image side can be solidified.

[Example of Gloss Processing Steps]

The following will briefly describe gloss processing steps in the back surface gloss processing apparatus 400. FIGS. 3A through 3D schematically show gloss processing steps in the back surface gloss processing apparatus 400. In this case, it is estimated for convenience of explanation that the sheet of paper P is transferred while the back surface of the sheet of paper is face upward. The invention, however, is not limited thereto.

The sheet of paper P on which the clear toner C is applied on an image T formed on the back surface thereof (see FIG. 3A) is set on the back surface gloss processing apparatus 400. When the back surface gloss processing apparatus 400 starts the gloss processing, the gloss-allowing belt 438 smooths a top surface of the clear toner C (see FIG. 3B). The cooling fans 442, 444 arranged above and below the transfer path cool the clear toner C so that the clear toner C is solidified (see FIG. 3C). This enables a smoothed clear toner layer C1 to be formed. Finally, the peel-off roll 436 peels the clear toner layer C1 from the gloss-allowing belt 438 (see FIG. 3D). The sheet of paper P on which the gloss processing has been performed is ejected to a paper-ejection tray 446. Thus, the back surface gloss processing apparatus 400 grants the back surface of the sheet of paper P any glossy effect.

[Configuration Example of Back Surface Gloss Processing Apparatus]

Figure 4:
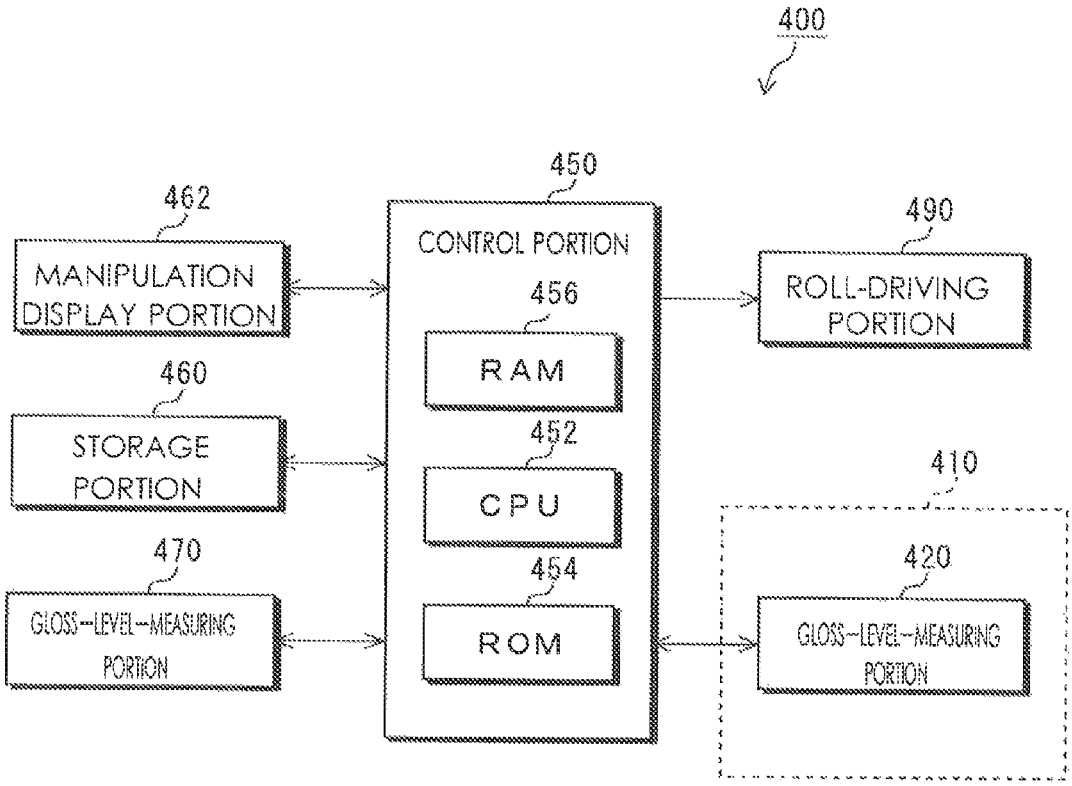
FIG. 4 is a block diagram showing a configuration example of the gloss processing apparatus for the back surface of the sheet of paper.

The following will describe a configuration example of the back surface gloss processing apparatus 400. FIG. 4 shows a configuration example of the back surface gloss processing apparatus 400. As shown in FIG. 4, the back surface gloss processing apparatus 400 contains a control portion 450 which controls operations of the whole apparatus. The control portion 450 includes central processing unit (CPU) 452, read only memory (ROM) 454 and random access memory (RAM) 456. The CPU 452 expands any programs and/or data read out of the ROM 454 on the RAM 456 and starts the programs to perform the gloss processing. In the gloss processing, the operation mode is changed to a proper operation mode based on whether or not the gloss processing is performed on the back surface of the sheet of paper P.

To the control portion 450, the manipulation display portion 462, the top surface gloss-level-measuring portion 470, a storage portion 460, a roll-driving portion 490 and the back surface gloss-level-measuring portion 420 are respectively connected. The manipulation display portion 462 is so configured as to have a touch screen in which a display portion composed of a liquid crystal panel or the like and a position detection portion of capacitive sensing type or resistive film type are combined. The manipulation display portion 462 receives any kinds of inputs such as a start or a stop of the gloss processing, fixing temperature and a transfer velocity of the sheet of paper during a period of gloss processing time, nipping pressure and any gloss processing conditions such as data on threshold values that are standards of gloss level used when determining whether or not the gloss process has been performed. The manipulation display portion 462 supplies to the control portion 450 a manipulation signal corresponding to such receiving.

The storage portion 460 is configured as to be nonvolatile semiconductor device, hard disk drive (HDD) or the like. The storage portion 460 stores, for example, a table TB indicating any gloss processing conditions to be used when performing the back surface gloss processing, the data on threshold values (for example, 50° C.) to be used when determining whether or not the gloss process has been performed, and the like. As the table TB, a table TB1 for the top surface gloss processing and a table TB2 for the back surface gloss processing are provided. In the table TB1 for the top surface gloss processing, for example, 170° C. is stored as a standard fixing temperature for the heater 432*a* and 40 mm/sec is stored as a standard transfer velocity of the sheet of paper. In the table TB2 for the back surface gloss processing, for example, 150° C. is stored as a standard fixing temperature for the heater 432*a* and 70 mm/sec is stored as a standard transfer velocity of the sheet of paper.

The top surface gloss-level-measuring portion 470 measures gloss level of the top surface of the sheet of paper P which has been passed through the gloss processing portion 430. The top surface gloss-level-measuring portion 470 supplies gloss level data based on a measurement result thereof to the control portion 450.

The roll-driving portion 490 is configured as to be, for example, a stepping motor. The roll-driving portion 490 drives the pressure roll 434 to rotate based on a driving signal according to the standard transfer velocity of the sheet of paper, which is supplied from the control portion 450. This rotation of the pressure roll 434 enables the heating roll 432 and the gloss-allowing belt 438 to be driven. Based on this, the gloss-allowing belt 438 is transferred so that the sheet of paper P can be transferred along the sheet-transferring direction D thereof. It is to be noted that by connecting the roll-driving portion 490 with the heating roll 432, not the pressure roll 434, the heating roll 432 may rotate.

The control portion 450 reads the table TB1 or TB2 corresponding to an operation mode selected according to the gloss level of the top surface of the sheet of paper P out of the storage portion 460 and controls the heater 432*a* to turn on electricity and to bring temperature of the nip portion N to the fixing temperature set in the table TB1 or TB2. Similarly, the control portion 450 controls the roll-driving portion 490 to bring the transfer velocity of the sheet of paper to a previously set one and controls the transfer of the sheet of paper P.

The back surface gloss-level-measuring portion 420 is arranged in the paper-supplying portion 410. The back surface gloss-level-measuring portion 420 measures any gloss level of the back surface of the sheet of paper P at the timing before the sheet of paper P is supplied to the gloss processing portion 430 and supplies to the control portion 450 data on the gloss level based on this measurement result thereof.

It is to be noted that although in this embodiment, a case has been described in which the control portion 450 is separated from the gloss processing portion 430 and controls the paper-supplying portion 410, this invention is not limited to such a configuration: The control portion 450 may be contained in the gloss processing portion 430. Further, the top surface gloss processing apparatus 300 has almost the same configuration and function as those of the above-mentioned back surface gloss processing apparatus 400.

[Operation Example of Back Surface Gloss Processing Apparatus]

Figure 5:
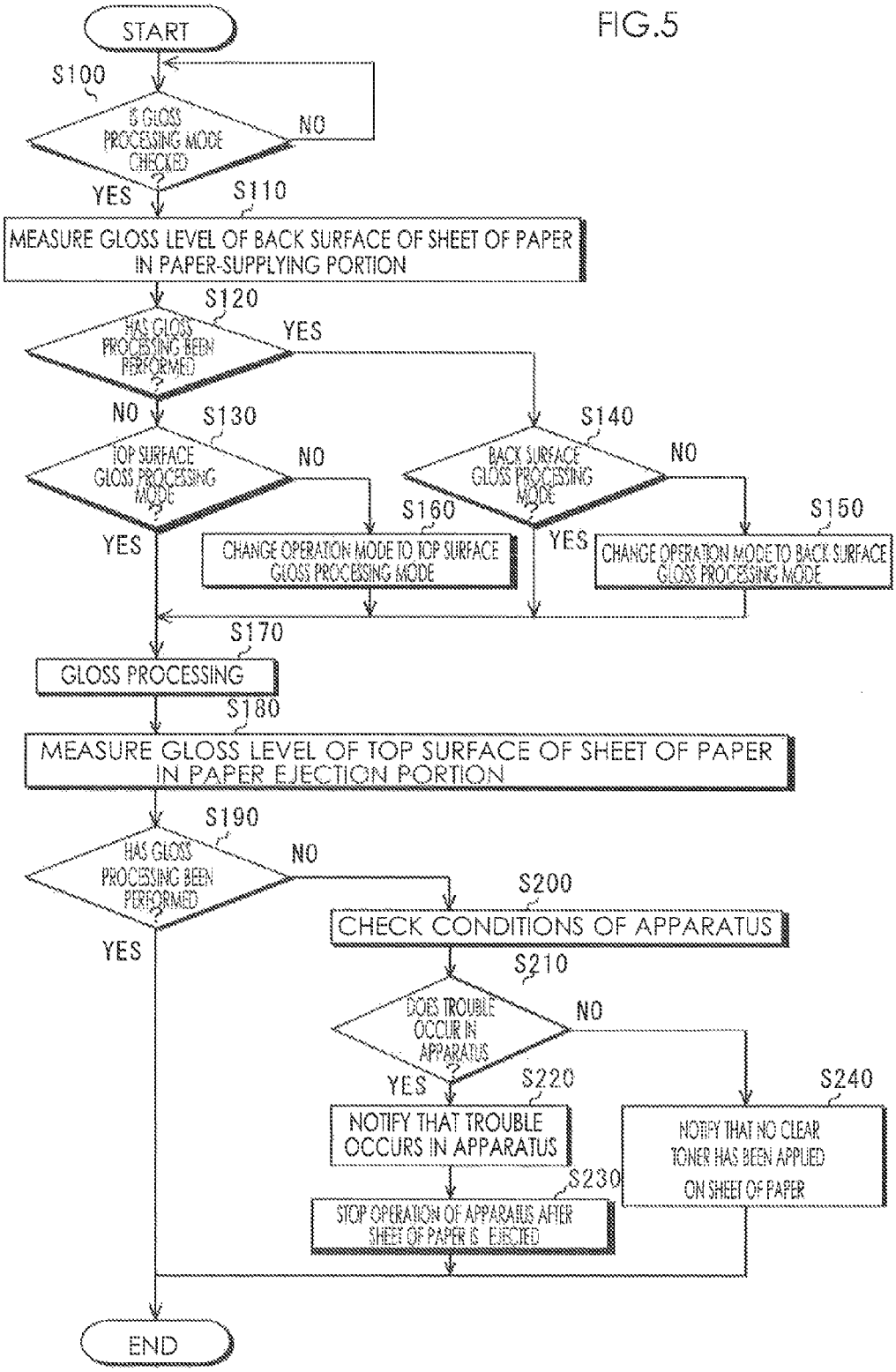
FIG. 5 is a flowchart showing an operation example of a control portion when the gloss processing apparatus for the back surface performs the gloss processing on the back surface of the sheet of paper.

The following will describe operation example of the control portion 450 or the like when the back surface gloss processing apparatus 400 performs the gloss processing. FIG. 5 shows a flowchart indicating an operation example of the control portion 450 or the like when the back surface gloss processing apparatus 400 performs the gloss processing. It is estimated that the top surface gloss processing apparatus 300 has performed the gloss processing on the top surface of the sheet of paper P and the back surface gloss processing apparatus 400 will perform the gloss processing on the back surface of the sheet of paper P, on which the clear toner layer has been formed. Accordingly, it is also estimated that in the back surface gloss processing apparatus 400, the back surface gloss processing mode is set as initial setting of the operation mode.

When finishing performing the gloss processing on the top surface of the sheet of paper P, the operator sets the sheet of paper P, on the back surface of which the gloss processing has not been yet performed, on the paper-supplying portion 410 of the back surface gloss processing apparatus 400.

As shown in FIG. 5, at a step S100, the operator checks a presently set gloss processing mode. In the back surface gloss processing apparatus 400, the back surface gloss processing mode is set as a standard setting thereof but one operator may change the operation mode suitably by using the manipulation screen of the manipulation display portion 462. When finishing checking the setting of the gloss processing mode, the manipulation for starting the gloss processing is performed on the manipulation screen of the manipulation display portion 462. The gloss processing (program therefor) is performed.

At a step S110, by the starting of the gloss processing, the control portion 450 controls the back surface gloss-level-measuring portion 420 to measure any gloss level of the back surface of the sheet of paper P taken out of the paper-supplying tray 412. The control portion 450 obtains from the back surface gloss-level-measuring portion 420 the measurement data, which is measured by the gloss-level-measuring portion 420, on the gloss level of the back surface of the sheet of paper P.

At a step S120, the control portion 450 determines whether or not the gloss processing has been performed on the back surface of the sheet of paper P taken out of the paper-supplying tray 412 based en the measurement data on the gloss level, which is obtained from the gloss-level-measuring portion 420. Particularly, the control portion 450 reads the threshold value, for example, 50° C. which is a standard gloss level, out of the storage portion 460 and determines whether or not the gloss level obtained from gloss-level-measuring portion 420 exceeds the previously set threshold value. The control portion 450 determines that the gloss processing has been already performed on the back surface of the sheet of paper P when the gloss level of the back surface of the sheet of paper P exceeds the previously set threshold value. The control portion 450 selects the back surface gloss processing mode. The control portion 450 then goes to a step S140. On the other hand, the control portion 450 determines that the gloss processing has not been yet performed on the back surface of the sheet of paper P when the gloss level of the back surface of the sheet of paper P does not exceed the previously set threshold value. The control portion 450 selects the top surface gloss processing mode. The control portion 450 then goes to a step S130.

If the control portion 450 determines that the gloss processing has been already performed on the back surface of the sheet of paper P at the step S120, then the control portion 450 determines whether or not the presently set operation mode is the back surface gloss processing mode at the step S140. If the control portion 450 determines that the presently set operation mode is the back surface gloss processing mode, then the control portion 450 goes to a step S170. On the other hand, if the control portion 450 determines that the presently set operation mode is not the back surface gloss processing mode, namely, the operation mode is set so as to be the top surface gloss processing mode, then the control portion 450 goes to a step S150. In this case, a case where the operator makes a mistake in setting the top surface gloss processing mode, not the back surface gloss processing mode to be correctly set, is conceivable.

If the control portion 450 determines that the presently set operation mode is not the back surface gloss processing mode at the step S140, then the control portion 450 automatically changes the presently set operation mode from the top surface gloss processing mode to the back surface gloss processing mode, at the step S150. This enables the operation mode to be changed to a proper operation mode corresponding to a case where the gloss processing is performed on the back surface of the sheet of paper P even if the operator makes a mistake in setting the operation mode to the top surface gloss processing mode. When changing the operation mode to the back surface gloss processing mode, the control portion 450 changes the setting of fixing temperature, a transfer velocity of the sheet of paper and the like so that they are suitable for the back surface gloss processing mode. Particularly, the control portion 450 controls the heater 432*a* to change the fixing temperature from 170° C. to 150° C. The control portion 450 also controls the roll-driving portion 490 to change the transfer velocity of the sheet of paper from 40 mm/sec to 70 mm/sec.

On the other hand, if the control portion 450 determines that the gloss processing has not been yet performed on the back surface of the sheet of paper P at the step S120, then the control portion 450 determines whether or not the presently set operation mode is the top surface gloss processing mode at the step S130. If the control portion 450 determines that the presently set operation mode is the top surface gloss processing mode, then the control portion 450 goes to the step S170. On the other hand, if the control portion 450 determines that the presently set operation mode is not the top surface gloss processing mode, then the control portion 450 goes to a step S160.

If the control portion 450 determines that the presently set operation mode is not the top surface gloss processing mode at the step S130, then the control portion 450 automatically changes the presently set operation mode from the back surface gloss processing mode to the top surface gloss processing mode, at the step S160. This enables the operation mode to be automatically changed to the top surface gloss processing mode which is applied to a case where the gloss processing is performed on the top surface of the sheet of paper P even if the operator makes a mistake in setting the sheet of paper P (on the top surface of which the gloss processing has not been performed), on the top surface of which the gloss processing will be performed in the top surface gloss processing apparatus 300, on the back surface gloss processing apparatus 400. When changing the operation mode to the top surface gloss processing mode, the control portion 450 changes the setting of fixing temperature, a transfer velocity of the sheet of paper and the like so that they are suitable for the top surface gloss processing mode. For example, the control portion 450 controls the heater 432*a* to change the fixing temperature from 150° C. to 170° C. The control portion 450 also controls the roll-driving portion 490 to change the transfer velocity of the sheet of paper from 70 mm/sec to 40 mm/sec.

At the step S170, the control portion 450 is configured as to perform the top surface gloss processing mode or the back surface gloss processing mode to perform the gloss processing which is suitable for the top or back surface of the sheet of paper P. Particularly, in the top surface gloss processing mode, based on the table TB1 stored on the storage portion 460, the control portion 450 sets the fixing temperature so as to be 170° C. and sets the transfer velocity of the sheet of paper so as to be 40 mm/sec to perform the gloss processing. In the back surface gloss processing mode, based on the table TB2 stored on the storage portion 460, the control portion 450 sets the fixing temperature so as to be 150° C. and sets the transfer velocity of the sheet of paper so as to be 70 mm/sec to perform the gloss processing. This allows the top or back surface of the sheet of paper P to be granted any glossy effect. When the gloss processing is finished, the sheet of paper P is transferred toward the paper ejection tray 446.

At a step S180, the control portion 450 controls the top surface gloss-level-measuring portion 470, which is arranged on the transfer path between the peel-off roll 436 and the paper ejection tray 446, to measure any gloss level of the top surface of the sheet of paper P. The control portion 450 obtains measurement data, which is measured by the top surface gloss-level-measuring portion 470, on the gloss level of the top surface of the sheet of paper P from the top surface gloss-level-measuring portion 470.

At a step S190, the control portion 450 determines whether or not the gloss processing has been performed on the top surface of the sheet of paper P passed through the gloss processing portion 430 based on the measurement data, which is obtained from the top surface gloss-level-measuring portion 470, of gloss level of the top surface of the sheet of paper P. In other words, the control portion 450 determines whether or not the gloss processing has been properly performed on the top surface of the sheet of paper P. Particularly, the control portion 450 reads the threshold value, which is a standard gloss level, out of the storage portion 460 and determines whether or not the gloss level obtained from the top surface gloss-level-measuring portion 470 exceeds the previously set threshold value. In this embodiment, the threshold value that is the same value as that used in the step S120 is used. The control portion 450 determines that the gloss processing is properly performed on the sheet of paper P when the gloss level of the top surface of the sheet of paper P exceeds the previously set threshold value. The sheet of paper P on which the gloss processing is performed is then ejected to the paper ejection tray 446 and the gloss processing is performed on the sheet of paper P next transferred from the paper-supplying portion 410. On the other hand, the control portion 450 determines that the gloss processing portion 430 does not properly perform the gloss processing on the sheet of paper P and any trouble occurs in the apparatus or a paper-setting mistake occurs therein when the gloss level of the top surface of the sheet of paper P does not exceed the previously set threshold value. The control portion 450 then goes to a step S200.

At the step S200, the control portion 450 checks conditions of the gloss processing portion 430. For example, the control portion 450 obtains from a pressure sensor arranged near the nip portion N formed between the pressure roll 434 and the heating roll 432 (the gloss-allowing belt 438) the nipping pressure at the nip portion N. The control portion 450 also obtains from a velocity sensor arranged on the transfer path the transfer velocity of the sheet of paper P. The control portion 450 further obtains from a temperature sensor arranged near the nip portion N the temperature of the nip portion N. Based on them, the control portion 450 checks the gloss processing conditions of the gloss processing portion 430.

At a step S210, the control portion 450 determines whether or not any troubles occur in the gloss processing portion 430 based on the conditions information of the apparatus thus obtained. The control portion 450 determines whether or not the nipping pressure, the transfer velocity of the sheet of paper, and the temperature of the nip portion indicate abnormal conditions based on whether or not each value of the nipping pressure, the transfer velocity of the sheet of paper, and the temperature of the nip portion exceeds each of their previously set threshold values. When the control portion 450 determines that any value of them indicates abnormal condition, the control portion 450 determines that any troubles occur in the gloss processing portion 430 and goes to a step S220.

At the step S220, the control portion 450 controls the manipulation display portion 462 to display a warning message such that the trouble occurs in the gloss processing portion 430 on its screen. When a cause of the trouble can be identified, the control portion 450 may control the manipulation display portion 462 to display specific contents of the cause of trouble. For example, when the temperature of the nip portion N is lower than the previously set standard temperature, the control portion 450 may control the manipulation display portion 462 to display such decreased temperature on its screen.

At a step S230, the control portion 450 allows ejecting the sheet of paper P passed through the gloss processing portion 430 to the paper ejection tray 446 and then stopping the operation of the back surface gloss processing apparatus 400. Thus, the interruption of the operation of the back surface gloss processing apparatus 400 can prevent any poor quality based on the above-mentioned issues from occurring in the image of the sheet of paper P which will be supplied and/or prevent a jam based on the above-mentioned issues from occurring.

On the other hand, if no trouble occur in the nipping pressure, the transfer velocity of the sheet of paper, and the temperature of the nip portion of the gloss processing portion 430 at a step S210, then the control portion 450 determines that no trouble occur in the gloss processing portion 430 and goes to a step S240. Since it is not based on any trouble occurred in the gloss processing portion 430 why the gloss level of the top surface of the sheet of paper P is lower than the previously set threshold value, at the step S240, the control portion 450 determines that any clear toner has not applied to the sheet of paper from the beginning. This is because even if any clear toner has not applied to the sheet of paper, the gloss level determined at the step S120 may be lower than the previously set threshold value and it may be determined that the gloss processing has not been performed on the sheet of paper P like the sheet of paper on which clear toner has been provisionally fixed. The control portion 450 controls the manipulation display portion 462 to display a message such that any clear toner has not applied to the sheet of paper on its screen. When any clear toner has not applied to the sheet of paper P, this sheet of paper P is ejected without stopping the operation of apparatus and the control portion 450 performs the gloss processing on the sheet of paper P which will be next supplied. This is because the clear toner may be applied to the sheet of paper P which will be next supplied. In this embodiment, such a series of operations enables the gloss processing.

As described above, according to this embodiment, it is possible to change the operation mode to the proper gloss processing mode automatically according to the gloss processing surface of the sheet of paper P even when the operator makes a mistake in setting the sheet of paper P, on the top surface of which the gloss processing has not been performed, on the back surface gloss processing apparatus 400 or setting the operation mode to the top surface gloss processing mode, not the back surface gloss processing mode. This can prevent a jam based on the less-attachment of the sheet of paper P onto the gloss-allowing belt 438 from occurring in the back surface gloss processing apparatus 400. This also can prevent any poor quality from occurring in the image based on any influence of moisture or the like.

Further, since, in this embodiment, the top surface gloss-level-measuring portion 470 is also arranged at a downstream side of the gloss processing portion 430 along the sheet-transferring direction D of the sheet of paper P, it is possible to determine whether or not the gloss processing is properly performed on the sheet of paper P. This enables reliability of the gloss processing apparatus to be easily improved with high accuracy. Further, even when the gloss processing is not performed on the sheet of paper P, it is possible to determine whether or not any trouble occurs in the back surface gloss processing apparatus 400 or there is another cause. This enables the reason why the gloss processing is not properly performed on the sheet of paper to be identified so that the back surface gloss processing apparatus 400 can be returned to normal rapidly and appropriately.

The technical scope of this invention is not limited to the above-mentioned embodiment(s): It contains any various modifications or alterations to the above-mentioned embodiment(s), in a limitation without any deviation from a spirit of this invention.

It should be understood by those skilled in the art that various modifications, combinations, sub-combinations and alterations may occur depending on design requirements and other factors insofar as they are within the scope of the appended claims or the equivalents thereof.

What is claimed is:

1. A gloss processing apparatus comprising:

a gloss processing portion that performs gloss processing on a sheet of paper on which clear toner has been provisionally fixed;

a gloss-level-measuring portion for a back surface of the sheet of paper which is an opposite surface of a top surface of the sheet of paper, on which the gloss processing portion performs the gloss processing, the gloss-level-measuring portion measuring a gloss level of the back surface of the sheet of paper, the gloss-level-measuring portion being positioned at an upstream side of the gloss processing portion along a sheet-transferring direction; and a control portion that is configured to select separate gloss processing modes according to a case where the gloss processing is performed on the back surface of the sheet of paper or a case where the gloss processing is not performed on the back surface of the sheet of paper, based on a measurement result of the gloss-level-measuring portion for the back surface of the sheet of paper, wherein the control portion changes its processing mode to the gloss processing mode selected on the base of the measurement result of the gloss-level-measuring portion for the back surface of the sheet of paper when the control portion determines that the gloss processing mode selected on the base of the measurement result of the gloss-level-measuring portion for the back surface of the sheet of paper is different from a previously set gloss processing mode.

2. The gloss processing apparatus according to claim 1 wherein the control portion determines whether or not the gloss processing is performed on the back surface of the sheet of paper by comparing the gloss level measured by the gloss-level-measuring portion for the back surface of the sheet of paper with a threshold value that is a criterion of the gloss level.

3. The gloss processing apparatus according to claim 1 wherein the gloss-level-measuring portion for the back surface of the sheet of paper contains plural sensors or a line sensor in which sensors are arranged on a line.

4. The gloss processing apparatus according to claim 1 further comprising a gloss-level-measuring portion for a top surface of the sheet of paper, the gloss-level-measuring portion measuring a gloss level of the top surface of the sheet of paper which has been passed through the gloss processing portion, the gloss-level-measuring portion for the top surface of the sheet of paper being positioned at a downstream side of the gloss processing portion along the sheet-transferring direction, wherein the control portion determines whether or not the gloss processing portion has properly performed the gloss processing on the top surface of the sheet of paper based on a measurement result of the gloss level of the top surface of the sheet of paper by the gloss-level-measuring portion for the top surface of the sheet of paper.

5. The gloss processing apparatus according to claim 4 wherein the control portion determines whether or not the gloss processing portion has properly performed the gloss processing on the top surface of the sheet of paper by comparing the gloss level measured by the gloss-level-measuring portion for the top surface of the sheet of paper with a threshold value that is a criterion of the gloss level.

6. The gloss processing apparatus according to claim 4 further comprising a notifying portion which notifies that the gloss processing portion has not properly performed the gloss processing on the top surface of the sheet of paper when the control portion determines that the gloss processing portion has not properly performed the gloss processing on the top surface of the sheet of paper.

7. The gloss processing apparatus according to claim 4 wherein the gloss-level-measuring portion for the top surface of the sheet of paper contains plural sensors or a line sensor in which sensors are arranged on a line.

8. The gloss processing apparatus according to claim 1 wherein the control portion is configured to select the gloss processing mode for the back surface of the sheet of paper when the gloss processing is performed on the back surface of the sheet of paper or to select the gloss processing mode for the top surface of the sheet of paper when the gloss processing is not performed on the back surface of the sheet of paper, and wherein the gloss processing modes for the top and back surfaces of the sheet of paper are different from each other in a gloss processing condition, during a period of gloss processing, including at least any one of fixing temperature and a transfer velocity of the sheet of paper.

9. The gloss processing apparatus according to claim 1 further comprising a paper-supplying portion that stores the sheet of paper on which the clear toner has been provisionally fixed and supplies the sheet of paper to the gloss processing portion, the paper-supplying portion being positioned at the upstream side of the gloss processing portion along the sheet-transferring direction, wherein the gloss-level-measuring portion for the back surface of the sheet of paper is arranged in the paper-supplying portion.

* * * * *